US010502069B2

(12) United States Patent
Jones et al.

(10) Patent No.: US 10,502,069 B2
(45) Date of Patent: Dec. 10, 2019

(54) TURBOMACHINE ROTOR BLADE

(71) Applicant: General Electric Company, Schenectady, NY (US)

(72) Inventors: Mark Andrew Jones, Ponte Vedra Beach, FL (US); Bradley Taylor Boyer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 113 days.

(21) Appl. No.: 15/615,876

(22) Filed: Jun. 7, 2017

(65) Prior Publication Data

US 2018/0355729 A1 Dec. 13, 2018

(51) Int. Cl.

| | |
|---|---|
| ***F01D 5/00*** | (2006.01) |
| ***F01D 5/18*** | (2006.01) |
| ***F01D 5/20*** | (2006.01) |

(52) U.S. Cl.

CPC ..... *F01D 5/187* (2013.01); *F01D 5/20* (2013.01); *F05D 2220/32* (2013.01); *F05D 2260/201* (2013.01)

(58) Field of Classification Search

CPC ..... F01D 5/20; F01D 5/225

See application file for complete search history.

(56) References Cited

U.S. PATENT DOCUMENTS

| | | | | |
|---|---|---|---|---|
| 3,876,330 A | | 4/1975 | Pearson et al. | |
| 4,127,358 A | * | 11/1978 | Parkes | F01D 5/187 416/191 |
| 6,099,253 A | * | 8/2000 | Fukue | F01D 5/187 416/191 |
| 6,146,098 A | * | 11/2000 | Fukuno | F01D 5/18 416/191 |

(Continued)

FOREIGN PATENT DOCUMENTS

| | | |
|---|---|---|
| EP | 2607629 A1 | 6/2013 |
| FR | 2275975 A5 | 1/1976 |

(Continued)

OTHER PUBLICATIONS

Extended European Search Report and Opinion issued in connection with corresponding EP Application No. 18175502.6 dated Oct. 12, 2018.

*Primary Examiner* — Hieu T Vo
*Assistant Examiner* — Sherman D Manley
(74) *Attorney, Agent, or Firm* — Dority & Manning, P.A.

(57) ABSTRACT

A rotor blade includes an airfoil defining at least one cooling passage and a camber line extending from a leading edge to a trailing edge. The rotor blade further includes a tip shroud coupled to the airfoil, the tip shroud and the airfoil defining a core fluidly coupled to the at least one cooling passage, the core including a plurality of outlet apertures, each of the plurality of outlet apertures including an opening defined in an exterior surface of the tip shroud. A first outlet aperture is oriented to exhaust cooling fluid through the opening (Continued)

thereof in a direction that is between 15 degrees from parallel to and parallel to the camber line at the trailing edge. A second outlet aperture is oriented to exhaust cooling fluid through the opening thereof in a direction that is greater than 15 degrees from parallel to the camber line at the trailing edge.

17 Claims, 5 Drawing Sheets

(56) References Cited

U.S. PATENT DOCUMENTS 6,254,346 B1 * 7/2001 Fukuno ..... F01D 5/187 415/115
6,471,480 B1 * 10/2002 Balkcum, III ..... F01D 5/186 415/115
6,499,950 B2 * 12/2002 Willett ..... F01D 5/182 416/97 R
6,761,534 B1 7/2004 Willett
6,932,571 B2 * 8/2005 Cunha ..... F01D 5/18 416/97 R
7,273,347 B2 * 9/2007 Rathmann ..... F01D 5/186 415/173.6
7,427,188 B2 * 9/2008 Neuhoff ..... F01D 5/187 416/97 R
7,686,581 B2 * 3/2010 Brittingham ..... F01D 5/187 416/97 R
7,946,816 B2 * 5/2011 Brittingham ..... F01D 5/225 416/189
7,946,817 B2 * 5/2011 Brittingham ..... F01D 5/186 416/189
8,057,177 B2 * 11/2011 Brittingham ..... F01D 5/187 416/189
8,096,772 B2 * 1/2012 Liang ..... F01D 11/001 415/115
8,348,612 B2 * 1/2013 Brittingham ..... F01D 5/225 416/191
8,684,692 B2 * 4/2014 Mayer ..... F01D 5/187 415/115
9,022,736 B2 * 5/2015 Lee ..... F01D 5/186 416/97 R
9,885,243 B2 * 2/2018 Chouhan ..... F01D 5/02
2001/0048878 A1 * 12/2001 Willett ..... F01D 5/182 416/97 R
2002/0150474 A1 * 10/2002 Balkcum, III ..... F01D 5/186 416/97 R
2004/0151587 A1 * 8/2004 Cunha ..... F01D 5/18 416/97 R
2007/0071593 A1 * 3/2007 Rathmann ..... F01D 5/186 415/115
2007/0154312 A1 * 7/2007 Neuhoff ..... F01D 5/187 416/97 R
2009/0180892 A1 * 7/2009 Brittingham ..... F01D 5/225 416/97 R
2009/0180893 A1 * 7/2009 Brittingham ..... F01D 5/186 416/97 R
2009/0180895 A1 * 7/2009 Brittingham ..... F01D 5/187 416/97 R
2009/0180896 A1 * 7/2009 Brittingham ..... F01D 5/225 416/97 R
2009/0304520 A1 * 12/2009 Brittingham ..... F01D 5/187 416/97 R
2010/0239432 A1 * 9/2010 Liang ..... F01D 11/001 416/97 R
2011/0194943 A1 * 8/2011 Mayer ..... F01D 5/187 416/97 R
2012/0207614 A1 * 8/2012 Lee ..... F01D 5/186 416/97 R
2017/0114645 A1 * 4/2017 Chouhan ..... F01D 5/02
2017/0254206 A1 * 9/2017 Schetzel ..... F01D 5/147

FOREIGN PATENT DOCUMENTS

GB GB 2298246 8/1996
JP 5868609 B2 1/2016
WO WO 94/11616 5/1994

* cited by examiner

TURBOMACHINE ROTOR BLADE

FIELD

The present disclosure generally relates to turbomachines. More particularly, the present disclosure relates to rotor blades for turbomachines.

BACKGROUND

A gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

The turbine section generally includes a plurality of rotor blades. Each rotor blade includes an airfoil positioned within the flow of the combustion gases. In this respect, the rotor blades extract kinetic energy and/or thermal energy from the combustion gases flowing through the turbine section. Certain rotor blades may include a tip shroud coupled to the radially outer end of the airfoil. The tip shroud reduces the amount of combustion gases leaking past the rotor blade. A fillet may transition between the airfoil and the tip shroud.

The rotor blades generally operate in extremely high temperature environments. As such, the airfoils and tip shrouds of rotor blades may define various passages, cavities, and apertures through which cooling fluid may flow. Nevertheless, conventional configurations of the various passages, cavities, and apertures may limit the service life of the rotor blades and require expensive and time consuming manufacturing processes. Further, in some cases, such conventional configurations may result in disturbance of the hot gas flow, resulting in reduced aerodynamic performance.

BRIEF DESCRIPTION

Aspects and advantages of the technology will be set forth in part in the following description, or may be obvious from the description, or may be learned through practice of the technology.

In accordance with one embodiment, a rotor blade for a turbomachine is provided. The rotor blade includes an airfoil defining at least one cooling passage, the airfoil further defining a camber line extending from a leading edge to a trailing edge. The rotor blade further includes a tip shroud coupled to the airfoil, the tip shroud and the airfoil defining a core fluidly coupled to the at least one cooling passage, the core including a plurality of outlet apertures, each of the plurality of outlet apertures including an opening defined in an exterior surface of the tip shroud. A first outlet aperture of the plurality of outlet apertures is oriented to exhaust cooling fluid through the opening of the first outlet aperture in a direction that is within 15 degrees of parallel to the camber line at the trailing edge. A second outlet aperture of the plurality of outlet apertures is oriented to exhaust cooling fluid through the opening of the second outlet aperture in a direction that is greater than 15 degrees from parallel to the camber line at the trailing edge.

In accordance with another embodiment, a rotor blade for a turbomachine is provided. The rotor blade includes an airfoil defining at least one cooling passage, the airfoil further defining a camber line extending from a leading edge to a trailing edge. The rotor blade further includes a tip shroud coupled to the airfoil, the tip shroud including a pressure side face, a suction side face, a leading edge face, and a trailing edge face, the tip shroud and the airfoil defining a core fluidly coupled to the at least one cooling passage, the core including a plurality of outlet apertures, each of the plurality of outlet apertures including an opening defined in an exterior surface of the tip shroud. The opening of a first outlet aperture of the plurality of outlet apertures is defined in the trailing edge face and the opening of a second outlet aperture of the plurality of outlet apertures is defined in one of the pressure side face, the suction side face, or the leading edge face. The first outlet aperture is oriented to exhaust cooling fluid through the opening of the first outlet aperture in a direction that is within 15 degrees of parallel to the camber line at the trailing edge. The second outlet aperture is oriented to exhaust cooling fluid through the opening of the second outlet aperture in a direction that is greater than 15 degrees from parallel to the camber line at the trailing edge.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
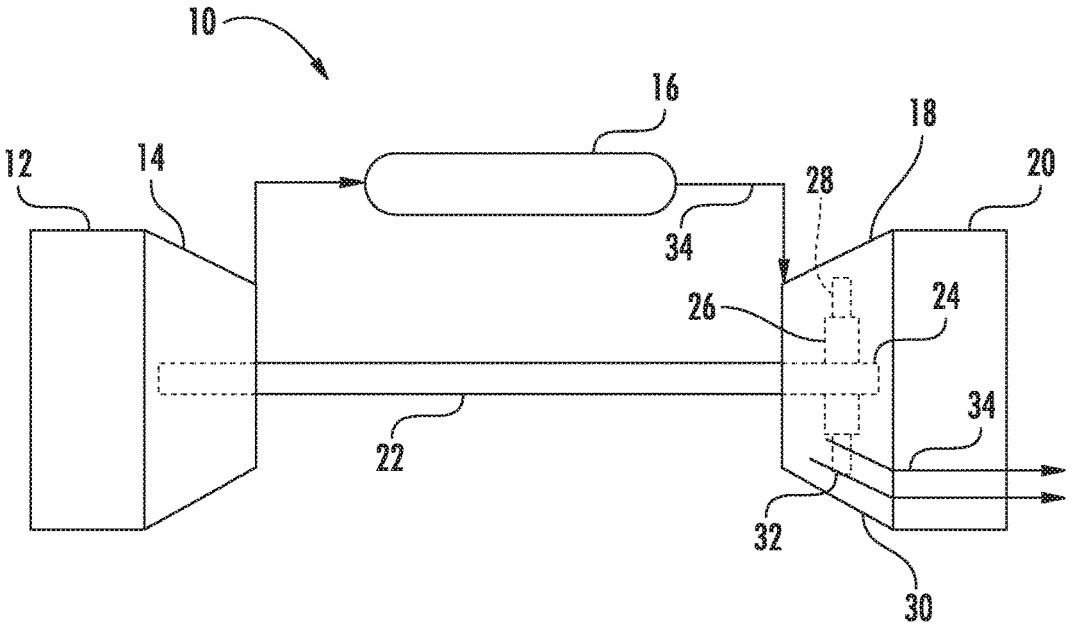
FIG. 1 is a schematic view of an exemplary gas turbine engine in accordance with embodiments of the present disclosure.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, wherein identical numerals indicate the same elements throughout the figures, FIG. 1 schematically illustrates a gas turbine engine 10. It should be understood that the gas turbine engine 10 of the present disclosure need not be a gas turbine engine, but rather may be any suitable turbomachine, such as a steam turbine engine or other suitable engine. The gas turbine engine 10 may include an inlet section 12, a compressor section 14, a combustion section 16, a turbine section 18, and an exhaust section 20. The compressor section 14 and turbine section 18 may be coupled by a shaft 22. The shaft 22 may be a single shaft or a plurality of shaft segments coupled together to form the shaft 22.

The turbine section 18 may generally include a rotor shaft 24 having a plurality of rotor disks 26 (one of which is shown) and a plurality of rotor blades 28 extending radially outward from and being interconnected to the rotor disk 26. Each rotor disk 26, in turn, may be coupled to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, air or another working fluid flows through the inlet section 12 and into the compressor section 14, where the air is progressively compressed to provide pressurized air to the combustors (not shown) in the combustion section 16. The pressurized air mixes with fuel and burns within each combustor to produce combustion gases 34. The combustion gases 34 flow along the hot gas path 32 from the combustion section 16 into the turbine section 18. In the turbine section, the rotor blades 28 extract kinetic and/or thermal energy from the combustion gases 34, thereby causing the rotor shaft 24 to rotate. The mechanical rotational energy of the rotor shaft 24 may then be used to power the compressor section 14 and/or to generate electricity. The combustion gases 34 exiting the turbine section 18 may then be exhausted from the gas turbine engine 10 via the exhaust section 20.

Figure 2:
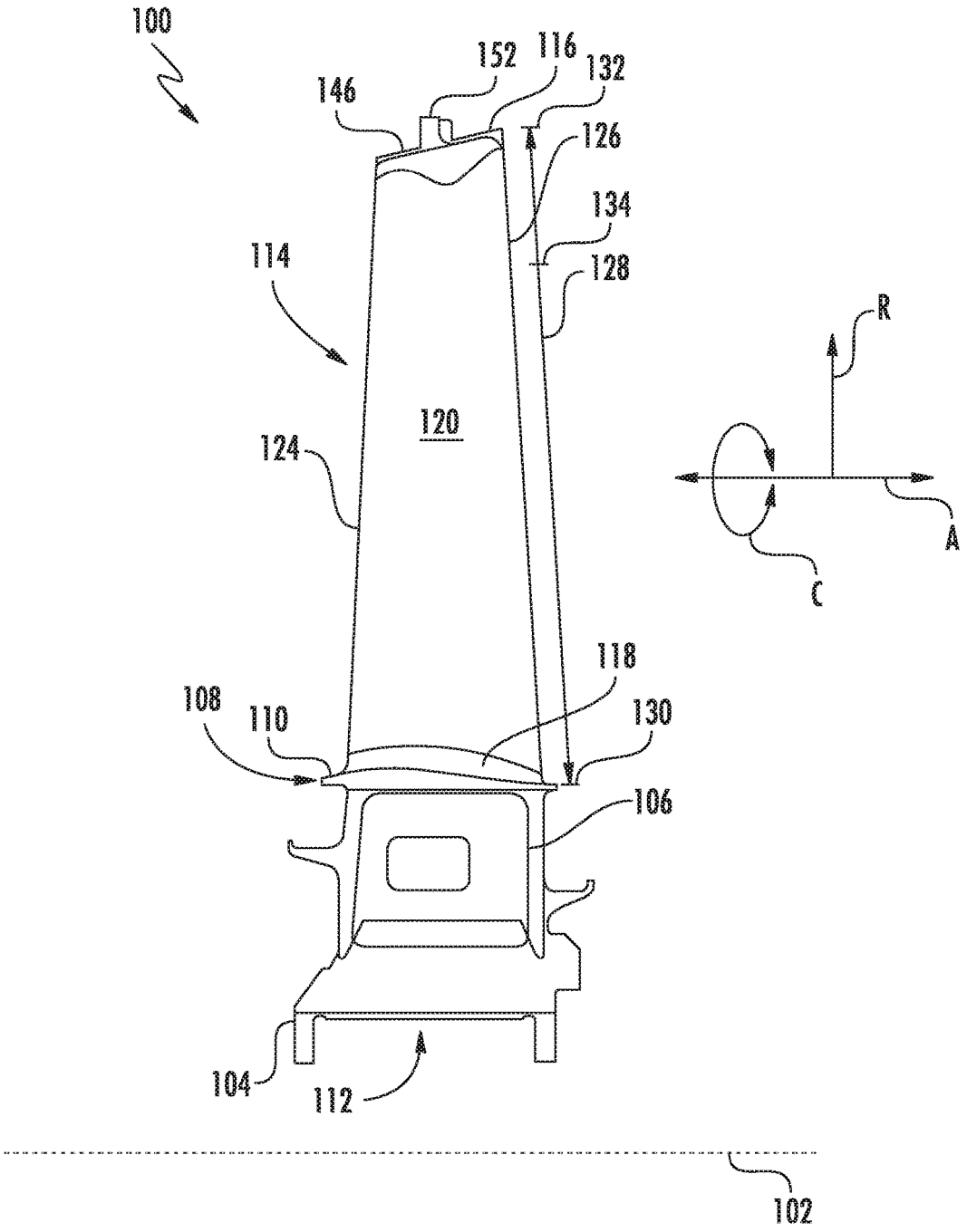
FIG. 2 is a front view of an exemplary rotor blade in accordance with embodiments of the present disclosure.

FIG. 2 is a view of an exemplary rotor blade 100, which may be incorporated into the turbine section 18 of the gas turbine engine 10 in place of the rotor blade 28. As shown, the rotor blade 100 defines an axial direction A, a radial direction R, and a circumferential direction C. In general, the axial direction A extends parallel to an axial centerline 102 of the shaft 24 (FIG. 1), the radial direction R extends generally orthogonal to the axial centerline 102, and the circumferential direction C extends generally concentrically around the axial centerline 102. The rotor blade 100 may also be incorporated into the compressor section 14 of the gas turbine engine 10 (FIG. 1).

As illustrated in FIG. 2, the rotor blade 100 may include a dovetail 104, a shank portion 106, and a platform 108. More specifically, the dovetail 104 secures the rotor blade 100 to the rotor disk 26 (FIG. 1). The shank portion 106 couples to and extends radially outward from the dovetail 104. The platform 108 couples to and extends radially outward from the shank portion 106. The platform 108 includes a radially outer surface 110, which generally serves as a radially inward flow boundary for the combustion gases 34 flowing through the hot gas path 32 of the turbine section 18 (FIG. 1). The dovetail 104, shank portion 106, and platform 108 may define an intake port 112, which permits cooling fluid (e.g., bleed air from the compressor section 14) to enter the rotor blade 100. In the embodiment shown in FIG. 2, the dovetail 104 is an axial entry fir tree-type dovetail. Alternately, the dovetail 104 may be any suitable type of dovetail. In fact, the dovetail 104, shank portion 106, and/or platform 108 may have any suitable configurations.

Figure 3:
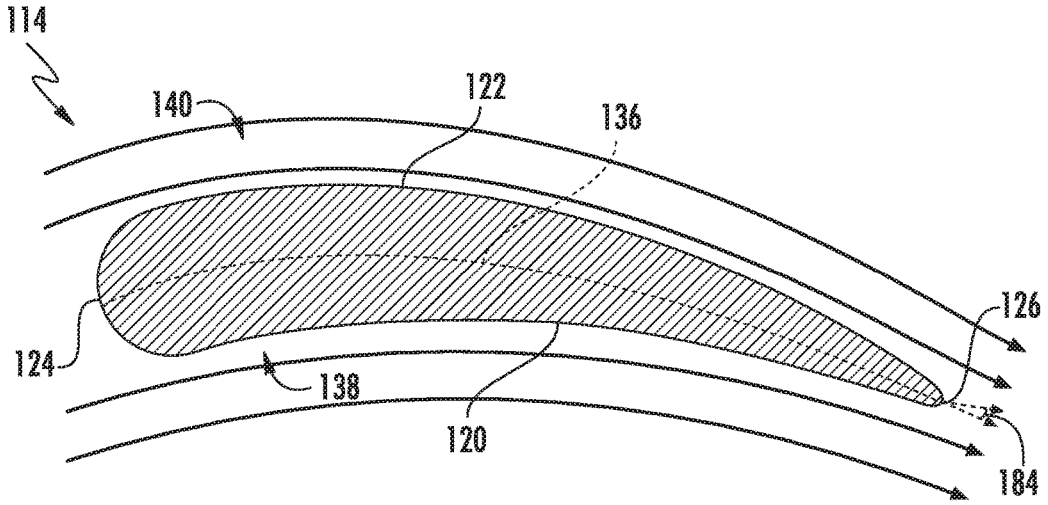
FIG. 3 is a cross-sectional view of an exemplary airfoil in accordance with embodiments of the present disclosure.
Figure 4:
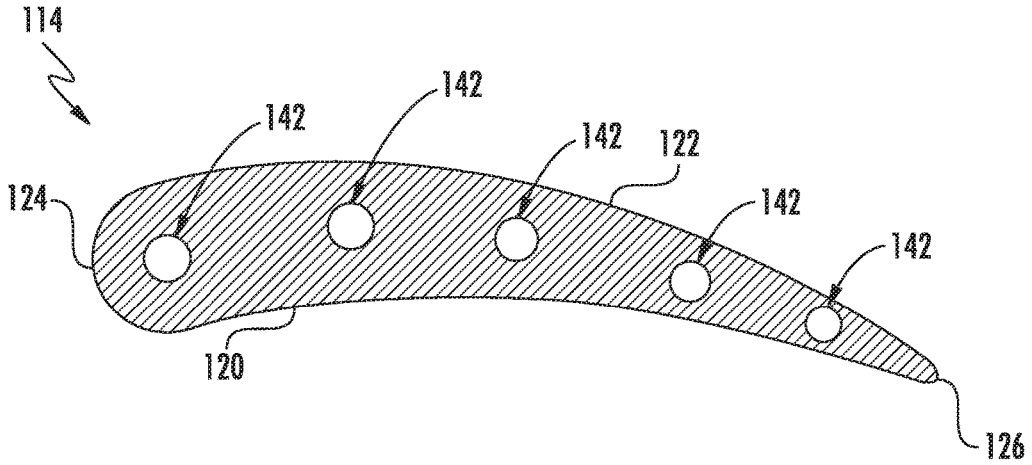
FIG. 4 is an alternate cross-sectional view of the airfoil shown in FIG. 3 in accordance with embodiments of the present disclosure.

Referring now to FIGS. 2-4, the rotor blade 100 further includes an airfoil 114. In particular, the airfoil 114 extends radially outward from the radially outer surface 110 of the platform 108 to a tip shroud 116. In this respect, the airfoil 114 couples to the platform 108 at a root 118 (i.e., the intersection between the airfoil 114 and the platform 108). The airfoil 114 includes a pressure side surface 120 and an opposing suction side surface 122 (FIG. 3). The pressure side surface 120 and the suction side surface 122 are joined together or interconnected at a leading edge 124 of the airfoil 114, which is oriented into the flow of combustion gases 34 (FIG. 1). The pressure side surface 120 and the suction side surface 122 are also joined together or interconnected at a trailing edge 126 of the airfoil 114 spaced downstream from the leading edge 124. The pressure side surface 120 and the suction side surface 122 are continuous about the leading edge 124 and the trailing edge 126. The pressure side surface 120 is generally concave, and the suction side surface 122 is generally convex.

Referring particularly to FIG. 2, the airfoil 114 defines a span 128 extending from the root 118 to the tip shroud 116. In particular, the root 118 is positioned at zero percent of the span 128, and the tip shroud 116 is positioned at one hundred percent of the span 128. As shown in FIG. 3, zero percent of the span 128 is identified by 130, and one hundred percent of the span 128 is identified by 132. Furthermore, ninety percent of the span 126 is identified by 134. Other positions along the span 128 may be defined as well.

Referring now to FIG. 3, the airfoil 114 defines a camber line 136. More specifically, the camber line 136 extends from the leading edge 124 to the trailing edge 126. The camber line 136 is also positioned between and equidistant from the pressure side surface 120 and the suction side surface 122. As shown, the airfoil 114 and, more generally, the rotor blade 100 include a pressure side 138 positioned on one side of the camber line 136 and a suction side 140 positioned on the other side of the camber line 136.

As illustrated in FIG. 4, the airfoil 114 may partially define a plurality of cooling passages 142 extending therethrough. In the embodiment shown, the airfoil 114 partially defines five cooling passages 142. In alternate embodiments, however, the airfoil 114 may define more or fewer cooling passages 142. The cooling passages 142 extend radially outward from the intake port 112 through the airfoil 114 to the tip shroud 116. In this respect, cooling fluid may flow through the cooling passages 142 from the intake port 112 to the tip shroud 116.

Figure 5:
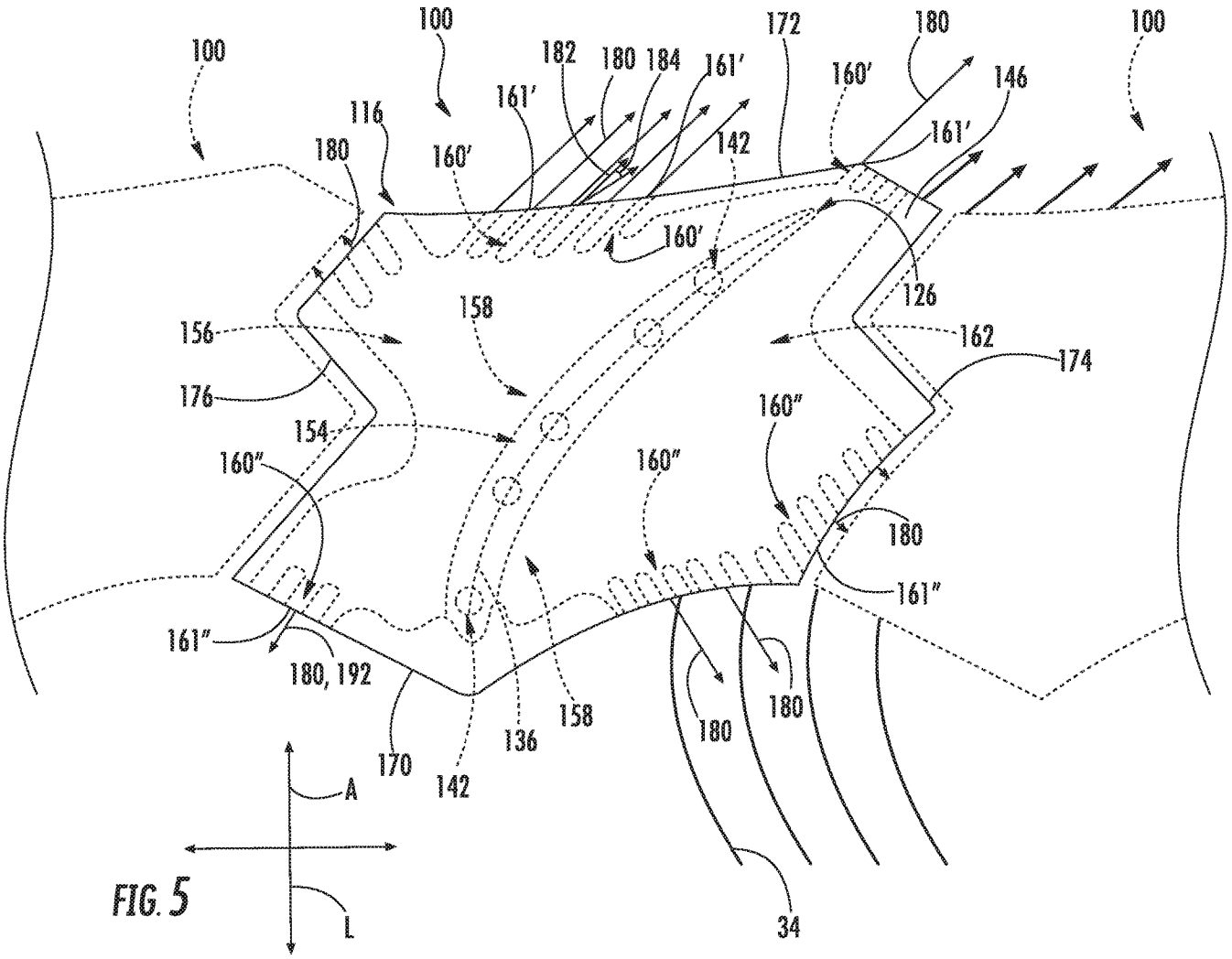
FIG. 5 is a top view of the rotor blade in accordance with embodiments of the present disclosure.
Figure 6:
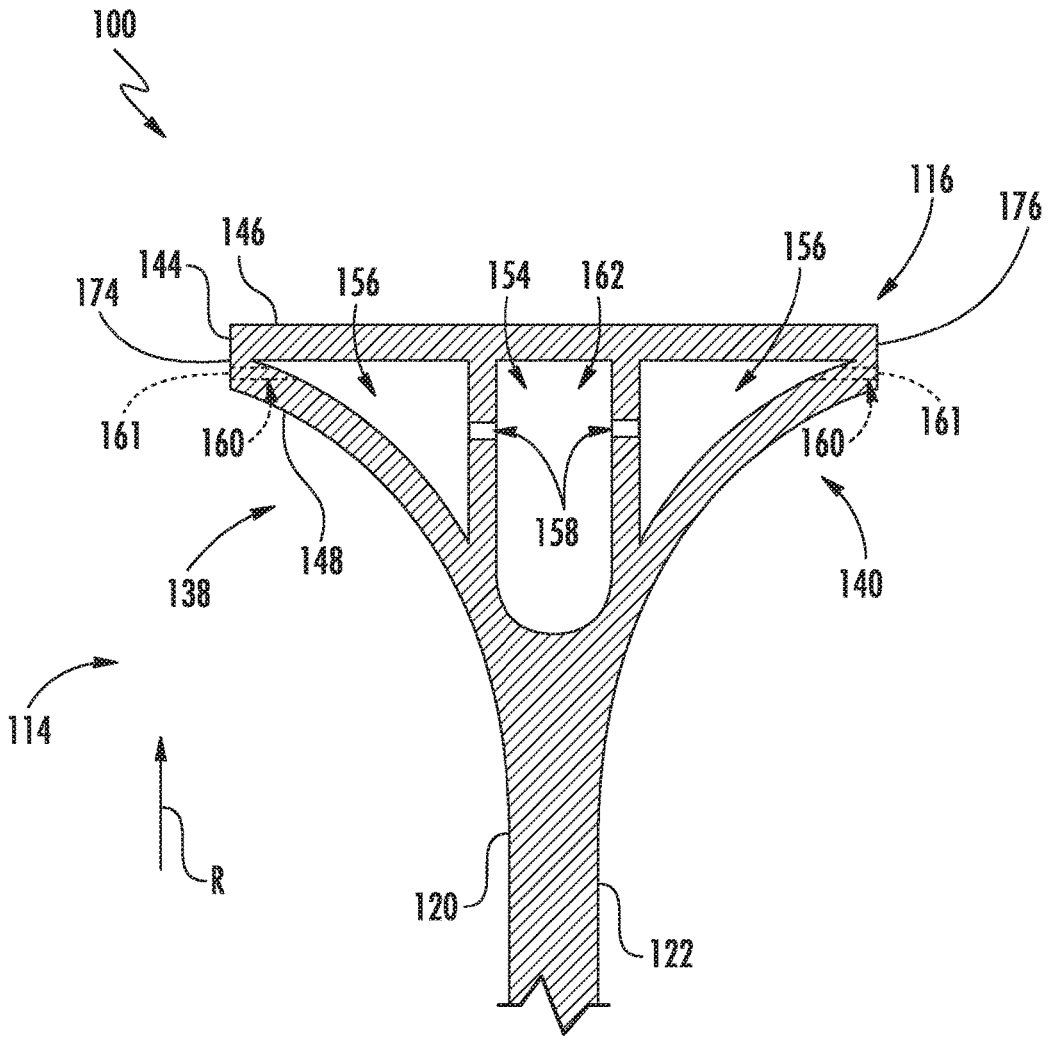
FIG. 6 is a cross-sectional view of the rotor blade in accordance with embodiments of the present disclosure.

As mentioned above, the rotor blade 100 includes the tip shroud 116. As illustrated in FIGS. 2 and 5, the tip shroud 116 couples to the radially outer end of the airfoil 114 and generally defines the radially outermost portion of the rotor blade 100. In this respect, the tip shroud 116 reduces the amount of the combustion gases 34 (FIG. 1) that escape past the rotor blade 100. The tip shroud 116 includes a side surface 144 which includes one or more non-radial faces of the tip shroud 116 as discussed herein. The tip shroud 116 further includes a radially outer surface 146 and a radially inner surface 148 (FIG. 6). In the embodiment shown in FIG. 2, the tip shroud 116 includes a seal rail 152 extending radially outwardly from the radially outer surface 148. Alternate embodiments, however, may include more seal rails 152 (e.g., two seal rails 152, three seal rails 152, etc.) or no seal rails 152 at all.

As mentioned, the side surface 144 includes one or more non-radial faces of the tip shroud 116. These non-radial faces may include, for example, a leading edge face 170, a trailing edge face 172, a pressure side face 174, and/or a suction side face 176. The leading edge face 170 generally faces the hot gas path 32 and thus is impacted by combustion gases 34 traveling past the blade 100. The trailing edge face 172 is generally opposite the leading edge face 170 along the axial direction A. The pressure side face 174 and suction side face 176 are generally opposite each other along the circumferential direction C. Further, a pressure side face 174 may face the suction side face 176 of a neighboring blade 100, and the suction side face 176 may face the pressure side face 174 of a neighboring blade 100, in a circumferential array of blades 100 in a stage.

Referring particularly to FIGS. 5 through 6, the tip shroud 116 defines various passages, chambers, and apertures to facilitate cooling thereof. The seal rail 152 shown in FIG. 2 is omitted from FIG. 5 for clarity. As shown, the tip shroud 116 defines a central plenum 154. In the embodiment shown, the central plenum 154 is fluidly coupled to the cooling passages 142. The tip shroud 116 also defines a main body cavity 156. One or more cross-over apertures 158 defined by the tip shroud 116 may fluidly couple the central plenum 154 to the main body cavity 156. Furthermore, the tip shroud 116 defines one or more outlet apertures 160 that fluidly couple the main body cavity 156 to the hot gas path 32 (FIG. 1). The tip shroud 116 may define any suitable configuration of passages, chambers, and/or apertures. The central plenum 154, the main body cavity 156, the cross-over apertures 158, and the outlet apertures 160 may collectively be referred to as a core 162.

During operation of the gas turbine engine 10 (FIG. 1), cooling fluid flows through the passages, cavities, and apertures described above to cool the tip shroud 116. More specifically, cooling fluid (e.g., bleed air from the compressor section 14) enters the rotor blade 100 through the intake port 112 (FIG. 2). At least a portion of this cooling flows through the cooling passages 142 and into the central plenum 154 in the tip shroud 116. The cooling fluid then flows from the central plenum 154 through the cross-over apertures 158 into main body cavity 156. While flowing through the main body cavity 156, the cooling fluid convectively cools the various walls of the tip shroud 116. The cooling fluid may then exit the main body cavity 156 through the outlet apertures 160 and flow into the hot gas path 32 (FIG. 1).

Referring still to FIGS. 5 through 6, and as illustrated, the tip shroud 116 may define a plurality of outlet apertures 160. Each outlet aperture 160 may fluidly couple the body cavity 156 to the hot gas path 32, and thus be in fluid communication with and between the body cavity 156 and hot gas path 32. More specifically, cooling fluid may flow from the body cavity 156 through each outlet aperture 160 and be exhausted from each outlet aperture 160 into the hot gas path 32. Each outlet aperture 160 may, for example, extend between the body cavity 156 and an opening 161 of the outlet aperture 160 that is defined in an exterior surface of the tip shroud 116. Such exterior surface may be a non-radial face of the side surface 144, the radially outer surface 146, or the radially inner surface 148. Accordingly, cooling fluid in the body cavity 156 may flow from the body cavity 156 into and through each outlet aperture 160, and be exhausted from the outlet aperture 160 through the opening 161 thereof into the hot gas path 32.

As discussed herein, one or more of the outlet apertures 160, referred to as first outlet apertures 160', may have a particularly advantageous positioning which facilitate improved turbomachine 10 performance. Specifically, cooling fluid exhausted through openings 161' of such outlet apertures 160' may be oriented with the hot gas path 32 direction of flow. Accordingly, such cooling fluid may supply additional thrust. Additionally, such orientation may reduce disturbances in the hot gas path 32 due to such exhausted cooling fluid interacting with the combustion gases 34, such as at various transverse angles, etc. Accordingly, improved aerodynamic performance is facilitated.

As shown, each such one or more first outlet apertures 160' may be oriented to exhaust cooling fluid 180 through the opening 161' thereof in a direction 182 that is within 15 degrees from parallel to the camber line 136 at the trailing edge 126 (i.e. between and including 15 degrees from parallel to the camber line 136 at the trailing edge 126 and parallel to the camber line 136 at the trailing edge 126). Further, in some embodiments, each such one or more first outlet apertures 160' may be oriented to exhaust cooling fluid 180 through the opening 161' thereof in a direction 182 that is within 10 degrees of parallel to the camber line 136 at the trailing edge 126, such as within 5 degrees of parallel to the camber line 136 at the trailing edge 126, such as parallel to the camber line 136 at the trailing edge 126. Such direction 182 may be defined in a top view plane defined partially by the axial direction A and as illustrated in FIG. 5. Angle 184, as illustrated in FIG. 5, may define such orientation of the direction 182 relative to the camber line 136.

As discussed, such openings 161' may be defined in exterior surfaces of the tip shroud 116. In exemplary embodiments, such exterior surface 161' for the first outlet apertures 160' may be a non-radial face. For example, in exemplary embodiments, such non-radial face may be the trailing edge face 172. Alternatively, however, such openings 161' may be defined in other non-radial faces or, for example, the radially outer surface 146 or radially inner surface 148.

Accordingly, in exemplary embodiments, cooling fluid 180 exhausted from first outlet apertures 160' through openings 161' thereof are oriented with the hot gas path 32 direction as the combustion gases 34 flow past the trailing edge 126.

Further, however, additional cooling flow 180 may be exhausted through openings 161 of other outlet apertures 160 different from the first outlet apertures 160'. For example, the plurality of outlet apertures 160 may further include one or more second outlet apertures 160", and cooling fluid 180 may be exhausted through openings 161" thereof. Advantageously, only a portion of the cooling fluid 180 is thus exhausted from first outlet apertures 160' as discussed above, while another portion of the cooling fluid 180 being exhausted from second outlet apertures 160" can be utilized for other purposes. For example, some of the cooling fluid 180 being exhausted from second outlet apertures 160" can be utilized for further cooling of the tip shroud 116. Additionally or alternatively, some of the cooling fluid 180 being exhausted from second outlet apertures 160" can be utilized for impingement cooling of faces of neighboring blades 100, as discussed above.

As shown, each such one or more second outlet apertures 160" may be oriented to exhaust cooling fluid 180 through the opening 161" thereof in a direction 192 that is greater than 15 degrees from parallel to the camber line 136 at the trailing edge 126. Further, in some embodiments, one or more of the second outlet apertures 160" may be oriented to exhaust cooling fluid 180 through the opening 161" thereof in a direction 192 that is greater than 30 degrees from parallel to the camber line 136 at the trailing edge 126, such as greater than 50 degrees from parallel to the camber line 136 at the trailing edge. Such direction 192 may be defined in a top view plane defined partially by the axial direction A and as illustrated in FIG. 5. Angle 184, as illustrated in FIG. 5, may define such orientation of the direction 192 relative to the camber line 136.

As discussed, such openings 161" may be defined in exterior surfaces of the tip shroud 116. In exemplary embodiments, such exterior surface 161" for one or more of the second outlet apertures 160" may be a non-radial face. For example, in exemplary embodiments, such non-radial face for one or more second outlet apertures 160" may be the leading edge face 170. Additionally or alternatively, in exemplary embodiments, such non-radial face for one or more second outlet apertures 160" may be the pressure side face 174 and/or suction side face 176. Additionally or alternatively, however, such openings 161" for one or more of the second outlet apertures 160" may be defined in other non-radial faces or, for example, the radially outer surface 146 or radially inner surface 148.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A rotor blade for a turbomachine, comprising:

an airfoil defining at least one cooling passage, the airfoil further defining a camber line extending from a leading edge to a trailing edge; and a tip shroud coupled to the airfoil, the tip shroud and the airfoil defining a core fluidly coupled to the at least one cooling passage, the core comprising a plurality of outlet apertures, each of the plurality of outlet apertures comprising an opening defined in an exterior surface of the tip shroud, wherein a first outlet aperture of the plurality of outlet apertures is oriented to exhaust cooling fluid through the opening of the first outlet aperture in a direction that is within 15 degrees of parallel to the camber line at the trailing edge and is oriented with a hot gas path direction of flow through the turbomachine, and a second outlet aperture of the plurality of outlet apertures is oriented to exhaust cooling fluid through the opening of the second outlet aperture in a direction that is greater than 15 degrees from parallel to the camber line at the trailing edge, whereby the cooling fluid exhausted through the opening of the first outlet aperture supplies additional thrust to the rotor blade and improved aerodynamic performance is facilitated.

2. The rotor blade of claim 1, wherein the first outlet aperture is a plurality of first outlet apertures.

3. The rotor blade of claim 1, wherein the opening of the first outlet aperture is defined in a non-radial face of the tip shroud.

4. The rotor blade of claim 3, wherein the non-radial face is a trailing edge face.

5. The rotor blade of claim 1, wherein the core comprises a body cavity, and wherein each of the plurality of outlet apertures is in fluid communication with the body cavity.

6. The rotor blade of claim 1, wherein the first outlet aperture is oriented to exhaust cooling fluid through the opening of the first outlet aperture in a direction that is within 5 degrees of parallel to the camber line at the trailing edge.

7. The rotor blade of claim 1, wherein the second outlet aperture is a plurality of second outlet apertures.

8. The rotor blade of claim 1, wherein the opening of the second outlet aperture is defined in a non-radial face of the tip shroud.

9. The rotor blade of claim 8, wherein the non-radial face is a leading edge face.

10. The rotor blade of claim 8, wherein the non-radial face is one of a pressure side face or a suction side face.

11. A rotor blade for a turbomachine, comprising:

an airfoil defining at least one cooling passage, the airfoil further defining a camber line extending from a leading edge to a trailing edge; and a tip shroud coupled to the airfoil, the tip shroud comprising a pressure side face, a suction side face, a leading edge face, and a trailing edge face, the tip shroud and the airfoil defining a core fluidly coupled to the at least one cooling passage, the core comprising a plurality of outlet apertures, each of the plurality of outlet apertures comprising an opening defined in an exterior surface of the tip shroud, wherein the opening of a first outlet aperture of the plurality of outlet apertures is defined in the trailing edge face and the opening of a second outlet aperture of the plurality of outlet apertures is defined in one of the pressure side face, the suction side face, or the leading edge face, and wherein the first outlet aperture is oriented to exhaust cooling fluid through the opening of the first outlet aperture in a direction that is within 15 degrees of parallel to the camber line at the trailing edge and is oriented with a hot gas path direction of flow through the turbomachine, and the second outlet aperture is oriented to exhaust cooling fluid through the opening of the second outlet aperture in a direction that is greater than 15 degrees from parallel to the camber line at the trailing edge, whereby the cooling fluid exhausted through the opening of the first outlet aperture supplies additional thrust to the rotor blade and improved aerodynamic performance is facilitated.

12. The rotor blade of claim 11, wherein the first outlet aperture is a plurality of first outlet apertures.

13. The rotor blade of claim 11, wherein the core comprises a body cavity, and wherein each of the plurality of outlet apertures is in fluid communication with the body cavity.

14. The rotor blade of claim 11, wherein the first outlet aperture is oriented to exhaust cooling fluid through the opening of the first outlet aperture in a direction that is within 5 degrees of parallel to the camber line at the trailing edge.

15. The rotor blade of claim 11, wherein the second outlet aperture is a plurality of second outlet apertures.

16. The rotor blade of claim 11, wherein the one of the pressure side face, the suction side face, or the leading edge face is the leading edge face.

17. The rotor blade of claim 11, wherein the one of the pressure side face, the suction side face, or the leading edge face is one of the pressure side face or the suction side face.

* * * * *